United States Patent [19]

Touzani

[11] Patent Number: 5,002,193

[45] Date of Patent: Mar. 26, 1991

[54] COLLAPSIBLE HOLLOW ARTICLES WITH LATCHING CONFIGURATION AND ATTACHED HANDLE

[76] Inventor: William N. Touzani, Wilhelminastraat 11, 2595 Em Den Haag, Netherlands

[21] Appl. No.: 394,371

[22] Filed: Aug. 15, 1989

[51] Int. Cl.[5] ..... B65D 1/40; B65D 23/10

[52] U.S. Cl. ..... 215/100 A; 220/94 R; 220/666; 215/1 C; 215/101

[58] Field of Search ..... 215/100 A, 100 R, 101, 215/1 C; 220/4 F, 85 H, 94 R, 85 B, 93, 666, 672; 294/27.1, 31.2, 32, 33

[56] References Cited

U.S. PATENT DOCUMENTS

| | | | |
|---|---|---|---|
| 1,184,366 | 5/1916 | Miller | 220/4 F X |
| 1,338,480 | 4/1920 | Altenberg | 215/101 |
| 2,029,051 | 1/1936 | Blevins | 220/85 H |
| 2,215,402 | 9/1940 | McDonald | 220/85 H |
| 3,017,883 | 1/1962 | Dickinson, Jr. | 215/100 R |
| 3,177,025 | 4/1965 | Short | 294/33 |
| 3,463,536 | 8/1969 | Updegraff et al. | 294/31.2 |
| 4,456,134 | 6/1984 | Cooper | 214/1 C X |
| 4,492,313 | 1/1985 | Touzant | 215/1 C |

FOREIGN PATENT DOCUMENTS

| | | | |
|---|---|---|---|
| 1130355 | 2/1957 | France | 215/100 A |

OTHER PUBLICATIONS

"Break Throughs in Bellow Design", copyright 1987, W. N. Touzani.

*Primary Examiner*—Sue A. Weaver
*Attorney, Agent, or Firm*—Ladas & Parry

[57] ABSTRACT

A collapsible, expansible, plastic hollow article having a top and a base joined by a substantially cylindrical side wall integral therewith and an aperture in the top, comprising a plurality of substantially circular bellows formed by conical sections integrally joined to create at least a portion of the article side wall, the conical sections comprising alternating short portions and long portions, said short portions being at a greater angle to the article axis than said long portions, and the lesser diameter junctures of the long portions with the short portions being formed to create fold rings for said substantially circular bellows.

A handle means comprising a clip snugly fits in between adjacent conical sections joined by a lesser diameter juncture, and a grip having a further support at a lower point of the side wall. Thus the hollow article can be held in a straight configuration.

2 Claims, 1 Drawing Sheet

COLLAPSIBLE HOLLOW ARTICLES WITH LATCHING CONFIGURATION AND ATTACHED HANDLE

BACKGROUND OF THE INVENTION

The field of the invention pertains to hollow articles such as containers and, in particular, bottles of flexible plastic construction, formed with a plurality of side wall bellows to permit collapse of the article. Examples of similar articles are disclosed in Diebolt et al U.S. Pat. No. 3,929,165 and French Patent No. 2,467,146, respectively. Typically at least one bellow, when axially urged, overcenters and latches itself in a collapsed state. To unlatch any collapsed bellow a pulling axial force need be exerted on the article.

Owing to the nature of the flexible plastic material used, an expanded article tends to wobble and as a result part of its contents may be spilled. Wobbling is apt to occur when the contents are hot.

SUMMARY OF THE INVENTION

According to the invention a collapsible, expansible, plastic hollow article having a top and a base joined by a substantially cylindrical side wall integral therewith and an aperture in the top, comprising a plurality of substantially circular bellows formed by conical sections integrally joined to create at least a portion of the article side wall, the conical sections comprising alternating short portions and long portions, said short portions being at a greater angle to the article axis than said long portions, and the lesser diameter junctures of the long portions with the short portions being formed to create fold rings for the substantially circular bellows, is characterized by a handle means, comprising a clip snugly fitting in between adjacent conical sections joined by a lesser diameter juncture, and a grip having a further support at a lower point of the side wall.

By causing the clip to embrace an upper, lesser diameter juncture, any displacement of the article by hand will be under control, in particular if its contents are hot.

Preferably in the article of the invention said further support comprises a further clip being spaced by said grip from the said clip over a distance corresponding with the axial distance between two lesser diameter junctures across plural and fully stretched bellows.

An even better hold of the handle means on the hollow article will be provided when the clip and the further clip are arranged to fit around inner fold rings, respectively. Thus the juncture between subsequent bellows will be frozen, as it were.

To ease the application of the handle means in the hollow article of the invention, both clips are arranged to have spreading means at their respective open ends.

Typically the hollow article will be blow-moulded from any appropriate plastic material. The handle means will be manufactured from any appropriate plastic or metallic material. Preferably the short portion of a bellow is substantially half as high as the long portion.

Apart from arresting the wobbling and bending of the bottle when it is expanded or partly expanded, the proper use of a handling means as described above will prevent splashing or spilling of liquid products from the bottle because it forces the user to collapse the lower bellows first.

It is to be understood that the term "substantially circular" comprises oval and polygonal configurations.

Also the term "substantially cylindrical" will include conical-shaped and barrel-shaped hollow articles.

DESCRIPTION OF THE PREFERRED EMBODIMENT

Figure 1:
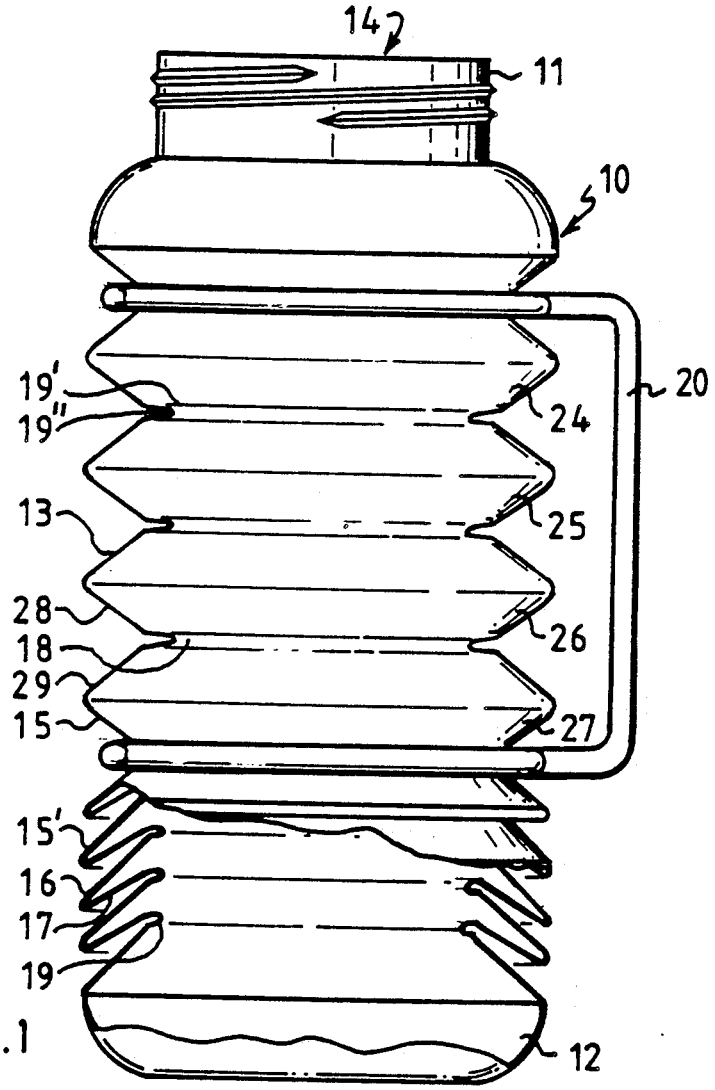
FIG. 1 is an elevational view, partly in cross-section, of a preferred embodiment of the invention.

In FIG. 1 a collapsible bottle 10 includes a top 11, a base 12 and integrally therewith a cylindrical side wall section 13 including a plurality of bellows, 15 and 15', for example. The bottle is shown partially collapsed. An upper part of the side wall section including bellows 24, 25, 26 and 27 is straightened by a rigid handle means 20 including two clips 21, 23. Said clips snugly fit in between adjacent conical sections 28, 29 that are joined by a lesser diameter juncture 18. Each bellow comprises two conical sections 16, 17, respectively, having different heights. The conical sections are alternating short portions and long portions, said short portions being at a greater angle to the article axis than said long portions. An aperture 14 is provided in the top 11 for filling or emptying the bottle 10.

In addition, the geometry of the bellow walls may be modified to reduce the unfolded angle between the walls at the inner fold rings 19, 19'. As a result the exterior approach to said inner fold ring in the unfolded condition is similar to a channel having a U-shaped cross-section.

Figure 2:
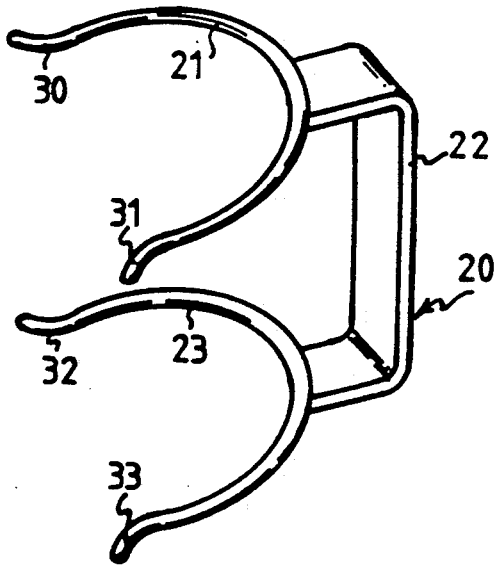
FIG. 2 is a perspective view of a handle means for use in the embodiment of FIG. 1.

In FIG. 2 a perspective view fully discloses handle means 20 including a grip 22, a clip 21 and a further clip 23. At the distal ends of each clip 21, 23 a pair of spreading means 30,31; 32, 33 are arranged to facilitate the entry of the clips in between two adjacent bellows. A clip wedges in between adjacent bellows and thus tends to straighten the bottle 10. If a clip is enabled to penetrate into a U-shaped channel 19'' it will have the same function as a locking device.

I claim:

1. A collapsible, expansible, plastic hollow article comprising: a top (11) and a base (12) joined by a substantially cylindrical side wall (13) having an axis integral with said top and said base and an aperture (14) in the top (11), said side wall comprising a plurality of substantially circular bellows (15, 15') formed by conical sections (16, 17) integrally joined to create at least a portion of said side wall (13), the conical sections (16, 17) comprising alternating short portions (17) and long portions (16), said short portions being at a greater angle to said axis than said long portions, said short portions joining with said long portions to form alternating junctures of greater and lesser diameters, the lesser diameter junctures (18) of the long portions joining with the short portions (17) being formed to create fold rings (19) for said substantially circular bellows, said short portions and said long portions also form U-shaped channels (19'') at said junctures of lesser diameters; and a handle means (20) comprising a first side wall support consisting of a first clip (21) dimensioned so as to snugly fit in between adjacent conical sections (28, 29) joined by said lesser diameter juncture (18) while embracing said lesser diameter juncture, said first clip having an open end, said handle means further comprising a grip (22) having a second side wall support axially spaced from said first side wall support at a lower point of the side wall (13), said clip is also dimensioned to fit into U-shaped channels (19'') around said fold rings (19, 19'').

2. A collapsible, expansible, plastic hollow article comprising:

a top;

a base;

a substantially cylindrical sidewall joining said top and said base, said cylindrical sidewall demarcating an axis intersecting said top and said base, said sidewall forming a plurality of substantially circular bellows; said bellows defined by alternating long and short conical portions, said short portions being at a greater angle to said axis than said long portions, said long portions and said short portions having a lesser diameter juncture to form fold rings; said short portions and said long portions further form U-shaped channels at said fold rings; and a handle, said handle having a first side wall support comprising a generally U-shaped first clip for attachment to said sidewall and a second side wall support, axially spaced below said first sidewall support, said first clip and said second side wall support joined by a gripping portion, said U-shaped first clip is configured to snugly fit around said fold rings and to be conveniently inserted or removed from between said conical portions, said clip is also configured to fit into said U-shaped channels around said fold rings.

* * * * *